US011577885B2

(12) United States Patent
Stathis

(10) Patent No.: US 11,577,885 B2
(45) Date of Patent: Feb. 14, 2023

(54) CUSTOMIZABLE PERSONALIZED INDIVIDUAL BEVERAGE BOTTLE

(71) Applicant: Shark Toolers, Morris Plains, NJ (US)

(72) Inventor: James Stathis, Morris Plains, NJ (US)

(73) Assignee: Stathis & Liebesfeld, LLC, Morris Plains, NJ (US)

( * ) Notice: Subject to any disclaimer, the term of this patent is extended or adjusted under 35 U.S.C. 154(b) by 159 days.

(21) Appl. No.: 17/005,720

(22) Filed: Aug. 28, 2020

(65) Prior Publication Data

US 2022/0063866 A1 Mar. 3, 2022

(51) Int. Cl.

| | |
|---|---|
| ***B65D 21/02*** | (2006.01) |
| ***B65D 23/08*** | (2006.01) |
| ***B65D 23/14*** | (2006.01) |
| ***B65D 41/02*** | (2006.01) |
| ***B65D 25/20*** | (2006.01) |
| ***B65D 25/36*** | (2006.01) |

(52) U.S. Cl.

CPC ..... *B65D 23/0885* (2013.01); *B65D 23/14* (2013.01); *B65D 25/205* (2013.01); *B65D 25/36* (2013.01); *B65D 41/02* (2013.01)

(58) Field of Classification Search

CPC ..... B65D 23/14; B65D 23/0085; B65D 25/205; B65D 25/36; B65D 41/02; B65D 2203/00; B65D 2203/02

USPC ..... 215/365; 206/459.1, 459.5, 217; 220/574

See application file for complete search history.

(56) References Cited

U.S. PATENT DOCUMENTS

| | | | | |
|---|---|---|---|---|
| 4,632,273 | A | 12/1986 | Rhine | |
| 4,984,723 | A | 1/1991 | Hsu | |
| 6,209,737 | B1 | 4/2001 | Bliss | |
| 6,405,675 | B1 | 6/2002 | Mills | |
| 8,245,870 | B2 | 8/2012 | McKinney et al. | |
| 2004/0262252 | A1 | 12/2004 | Hammer | |
| 2008/0314775 | A1* | 12/2008 | Owoc | B65D 55/0854 206/222 |
| 2009/0080180 | A1 | 3/2009 | Bertken | |
| 2014/0144913 | A1* | 5/2014 | Tiefenthaler | B67B 7/18 81/3.4 |
| 2018/0237186 | A1* | 8/2018 | Stathis | B65D 23/0885 |

* cited by examiner

*Primary Examiner* — John K Fristoe, Jr.
*Assistant Examiner* — Elizabeth J Volz
(74) *Attorney, Agent, or Firm* — Baldini Law, LLC

(57) ABSTRACT

An individual beverage bottle, with added convenience features making the bottle easy to open, and provides features to customize, personalize, and/or share in a very hygienic manner and providing a mechanism to secure a cup to the bottle such that an otherwise ordinary cup adapts and screws onto existing beverage containers that can be used to share the beverage or just be able to drink from a cup rather than directly from the bottle wherein, existing bottles can be utilized with very little, if any, extra footprint and minimal retooling. A proprietary labeling system is adapted to the bottle and cup.

14 Claims, 16 Drawing Sheets

CUSTOMIZABLE PERSONALIZED INDIVIDUAL BEVERAGE BOTTLE

FIELD OF THE INVENTION

An individual beverage bottle, with added convenience features making the bottle easy to open, and provides features to customize, personalize, and/or share in a very hygienic manner and providing a mechanism to secure a cup to the bottle such that an otherwise ordinary cup adapts and screws onto existing beverage containers that can be used to share the beverage or just be able to drink from a cup rather than directly from the bottle wherein, existing bottles can be utilized with very little, if any, extra footprint and minimal retooling. A proprietary labeling system is adapted to the bottle and cup.

BACKGROUND

There are a variety of circumstances where a need arises to be able to (a) identify a particular beverage container as belonging to someone where many identical beverages are being consumed; and (b) share a beverage from an individual beverage container in a sanitary manner. Firstly, so-called individual beverages are sold in containers that are twelve ounces, sixteen ounces, twenty ounces or more or some other volume that is more than one individual may want or need as an immediate serving. Or, where one person is drinking from such a container, they will set it down somewhere and then have it get mixed up with other identical looking containers that others have set down and no one knows whose is whose. There are often situations where the beverage will be consumed in situations where there are others present who may want or need some of the beverage. Drinking directly from the beverage container is not sanitary—even in the situation where you are the only one drinking from it. Studies show that drinking directly from a beverage container introduces bacteria and pathogens from the mouth of the person drinking back into the beverage container. Additionally, placing one's mouth directly against the container contaminates the mouth of the container itself. Thus, it would be advantageous to have access to a sanitary cup for use in consuming a beverage from an individual beverage container, whether the purchaser alone will be consuming the beverage or in the case of sharing it. However, in typical situations, when a consumer buys an individual beverage, they do not have access to a sanitary cup. Purchasing cups separate from the beverage is an inconvenience and generally would provide more than just the one needed cup.

In social settings where mandated social distancing is required, the foregoing problems are exacerbated. People use all manner of ways to identify their bottle, including writing on the label with a marker, ripping the label in a unique manner, and putting some kind of tape or other marking on the bottle itself. None of these methods are ideal because firstly, writing requires a marker that may not be available, a piece of tape or other marking could fall off, and ripping the label may cause the whole label to fall off.

There have been attempts to solve some of the sharing and sanitary issues described. Some containers come with attached straws. While the use of a straw may partially solve the issue of direct contamination of the mouth in contact with the mouth of the container, it does not solve the issue of introducing bacteria and pathogens into the beverage as studies have shown that using straws still allows a 'backwash' back into the beverage. Moreover, unless there was more than one straw, the issue of sharing is not solved. A straw is also not identification of the bottle itself as to whom it belongs.

There also have been attempts to include a cup with an individual bottle. As we can see from the below examples, these attempts have not provided a cup that is convenient, does not alter the space occupied by the bottle, is sanitary, and works as an identifiable pair in conjunction with the rest of the device as described herein. Some of the attempts have solved some of the foregoing issues, but have none have encompassed all, or done so in the manner, simplicity and elegance described here.

For example, U.S. Pat. No. 6,405,675 titled WATER BOTTLE ASSEMBLY HAVING A REMOVABLE WATER BOWL, discloses, "a water bottle assembly having a removable water bowl for providing a receptacle for watering a pet while outdoors includes a bottle, a lid, and a bowl removably couplable to the water bottle for carrying the water bottle and a bowl as a single unit. In an embodiment, the lid includes a spout assembly. In one embodiment, the bowl is coupled to the water bottle by frictional engagement to a strip of compressible material circumscribing an outer surface of the water bottle. In an embodiment, the upper edge of the water bottle extends from the outer surface of the water bottle for facilitating grasping of the bowl when removing the bowl from the water bottle." Here, the coupling of the bowl to the cup provides a ridge that would not be compatible with the labeling disclosed by the instant disclosure and there are no bottle cap tabs or protective sanitary strips.

In another example, U.S. Pat. No. 4,632,273 titled DISPOSABLE INSULATED CONTAINER, discloses, "a disposable insulated container and drinking cup combination wherein the insulated container is manufactured from plastic foam material and has a lid applied thereto. At least one inverted drinking cup mounted upon the top of the container with the cup, container, and lid sealingly secured in a package by a frangible ring encircling the lower edge of the inverted drinking cup and the periphery of the container." Here, the cup is disposable and attached to the container in a sanitary manner. However, it increases the height of the container excessively and would also not be compatible with the labeling disclosed in the instant disclosure.

In another example, U.S. Pat. No. 4,984,723 titled ASSEMBLY OF BEVERAGE BOTTLE/CAN AND CUP, discloses, "an assembly of beverage bottle/can and cup consisting of a beverage bottle or can for containing the beverage and a cup for encasing the lower part of said bottle or can to be integrated as one body, wherein a plurality of parallel linear projections are provided to the inner wall at the upper part of cup whereon a plurality of vent grooves are spaced in a suitable distance in the direction perpendicular to the said projections, and a clip is provided to the outer upper edge of cup; the said assembly provides the consumers with the convenience of pouring the beverage for drinking as they like by taking the advantage of the cup, fixing the bottle or can onto their knapsack bag or girdle optionally by means of the clip, and bringing the beverage bottle or can with them if the beverage therein has not been drunk up." Here, the cup slides over the bottom of the container, not significantly increasing the footprint of the container, but it is designed to fit so tight, i.e., it grips the container as its manner of securing to the container that it requires vent grooves to allow it to slip on fully, thus destroying any potential for sanitary condition.

In another example, U.S. Pat. No. 6,209,737 titled CUP ASSEMBLY FOR BOTTLE WITH ATTACHMENT MECHANISM, discloses, a "cup assembly for a bottle includes a body having a closed end with an aperture extending therethrough and an open end and a wall tapering from the closed end to the open end. The cup assembly also includes an attachment mechanism to attach the body to an open end of the bottle to allow a user to drink from the open end of the body while attached to the bottle." Here, the only object is to provide the convenience of drinking from a cup, but actually turns the bottle operatively into a cup and thus, solves none of the sanitary issues described, nor any labeling or sharing potential.

In another example, U.S. Patent Application Serial No. US 2004/0262252 titled MUG FIXED TO THE TOP OR THE BOTTOM OF A BEVERAGE BOTTLE BEVERAGE BOTTLE DESIGNED FOR RECEIVING SAME, AND RELATED COMBINATION discloses, "a beverage bottle provided with a mug acting as a closure, a bottle whereon fixing an upturned mug is realized with little effort. Consequently, the invention concerns a combination of a beverage bottle and a mug capable of being pressed on at least one end of the bottle and thereby be fixed to said end. The mug and/or the beverage bottle comprise, in the fixing zone, a profiled shape enabling, when the mug is upturned and pressed, a gas exchange between the inside of the mug and outside environment." Again, here, there is a gas exchange need destroying any sanitary possibility. Moreover, the mug acts as the cap to the bottle. Thus, there is no possibility of recapping the bottle once the mug has been used and maintaining a sanitary condition or facilitating the labeling features described in the instant disclosure.

Finally, in another example, U.S Patent Application Serial No. US 2009/0080180 titled, BEVERAGE BOTTLE WITH ACCESSORIES, discloses, "a configurable beverage container comprises a container body defining a central axis and bounded by non-opaque sides, an openable top, and a bottom defining a cavity in which a liquid can be retained. The container body includes a connector, such as a set of female thread portions, located on a lower end of the container body adjacent the container body bottom. The configurable container further includes an accessory having an accessory connector (e.g. male thread) located on a top end thereof and another (e.g. female thread) on a bottom thereof, with the top end configured to be coupled to the container body connector along a long axis of the container body. Examples of accessories include a first-aid kit, a GPS, a powers source, and a flashlight." Here, there are male and female threads to enable a screw coupling, however, the only contemplated placement is at the ends of the container and/or additional accessories which would elongate the container as additional accessories are added. Moreover, a cup is not one of the contemplated accessories and if it were, in the manner disclosed, it would as much as double the footprint of the bottle. Moreover, the labeling features described in the instant disclosure are not compatible with this configuration.

None of the foregoing references, alone or in combination, teach the salient and proprietary features or construction of the present disclosure, and as such, fail to be useful as a beverage container comprising protrusions on the cap that facilitate easy opening and double as writing nubs coupled with a proprietary writing surface, and a beverage container accessory that is convenient, sanitary and does not significantly alter the footprint of the existing container, further comprising a customizable, integrated labeling platform.

The present disclosure teaches several embodiments that provide a very convenient, inexpensive, sanitary individual beverage accessory that can be used with existing individual beverage containers with only minor retrofitting to provide a shareable drinking cup without altering the current space footprint of the existing container in any appreciable manner. The present disclosure also teaches embodiments for identifying whose bottle and container each is intended for use by without requiring any outside marking utensil. Moreover, the writing method taught herein also is useful for making the bottle easier to open for those who do not otherwise possess the hand strength to open typical bottles easily. There are also embodiments utilizing the basic configuration to expand and include various other ingredients that are commonly used with liquids commonly sold in individual beverage containers.

SUMMARY

The present disclosure teaches embodiments that utilize existing materials configured in such a way as to provide: (i) an individual beverage container accessory attachable to an individual beverage container in a sanitary manner; (ii) a linking ring configured to be affixed to an individual beverage container at some predefined mid-section point and further configured to mate with said individual beverage container accessory; (iii) a beverage container cap with nubs providing greater leverage to twist the cap open and also serve as a writing utensil with a configured proprietary writing surface label; and (iv) a proprietary writing surface label that covers at least a portion of the beverage container and a portion of the beverage container accessory that can function as a single writing surface when the beverage container and beverage container accessory are together and as separate writing surfaces when they are apart; wherein, when said individual beverage container accessory is mated with said linking ring, a sanitary seal is formed and further wherein said individual beverage container accessory is sized such that it slips over an individual beverage container with minimal clearance so as not to increase the footprint of said individual beverage container in any significant manner while also slipping on easily and configured to allow the attachment mechanism to function as intended and further wherein the protrusions on the cap also act as the writing nubs that form the writing on the proprietary writing surface(s).

In one embodiment, a cap with nubs providing greater leverage to twist the cap open and also serve as a writing utensil with a configured proprietary writing surface label; and a proprietary writing surface label is provided that can adapt to be utilized with any container. For example, and without limitation, a jar of pickles could implement such a combination making the cap easier to twist on and off and providing a label to customize the jar and provide a date of opening or other data important to a user.

In one embodiment, the individual beverage container accessory (2) is configured to be a cup used for drinking the contents of the individual beverage container (1). In one embodiment said accessory cup is configured to be just sufficiently larger than the individual beverage container such that it can slip over same without causing a pressure buildup of trapped air but also not increasing the footprint of the container in any significant or appreciable manner. (See FIG. 1). In one embodiment, the individual beverage container accessory (2) also comprises a cover (12) that is configured to just fit over the bottom and the top of the individual beverage container accessory such that when purchased, both the individual beverage container accessory (2) and the described cover (12) are fit over the individual beverage container, and the cover can also serve as a lid for the individual beverage container accessory. (See FIGS. 13A, 13B, 14A, and 14B).

In other embodiments, the individual beverage container accessory (2) could be configured to be a storage container of some type and would in this configuration, add a dimension of height to the individual beverage container, but no appreciable or significant width or circumference footprint. In some embodiments, the individual beverage container accessory (2) fits as a sheath, sliding over the bottom of the individual beverage container (1) and may be designed to be sixty percent of the capacity of the individual beverage container. In one embodiment, this capacity may be fifty percent. In one embodiment, the individual beverage container accessory is marked with a fill line.

In one embodiment, when the individual beverage container accessory (2) is attached to the individual beverage container (1), a sanitary seal is initially formed, either through a water-tight mating of surfaces, or through a screw on type of mating or snap on type of mating as described elsewhere herein, or a combination of methods, a tamper evident seal (6) may be placed over the attached components. In one embodiment, the tamper evident seal (6) may also function as a plastic band that keeps the individual beverage container accessory (2) attached to the individual beverage container (1) until it is removed and also maintains the sanitary nature until use. In one embodiment, this tamper evident seal (6) can have a quick removal tab (7) and can also serve to prevent premature scratching of the proprietary labeling system as described.

In one embodiment, the individual beverage container accessory (2) and linking ring (9, 10) may be configured in any number of diameters and heights to accommodate virtually any individual beverage container and/or purpose of use, whether as a cup or as a storage container.

In one embodiment, the individual beverage container accessory (2) is configured to be and act like a sheath in the manner in which it fits over the individual beverage container. In one embodiment, this accessory is made from a clear or otherwise see-through material such that the graphics and/or branding on the surface of the underlying individual beverage container is not concealed or altered. In an alternative embodiment, this accessory can be constructed from a material that intentionally alters the graphics and/or branding on the surface of the underlying individual beverage container to produce certain desired special effects, such as but not limited to, magnification, 3-D effects, holographic effects, glittery effects, accents and the like.

In one embodiment, the individual beverage container accessory (2) is made from a material that is of sufficient structure that it can stand on its own and function as a cup or storage container and sit on a level dry surface in a sturdy manner.

In one embodiment, the individual beverage container accessory (2) is made from a material sufficiently rigid to hold a beverage over a range of temperatures, ice cubes, and other common beverage ingredients when filled.

In one embodiment, the individual beverage container accessory (2) is configured with female screw threads at its top inner surface (10) such that it is capable of mating with suitable counterpart male screw threads on a linking ring fitted onto an individual beverage container (9). In another embodiment, the configuration of the threads is reversed. In another embodiment, the linking mechanism could be any known secure linking mechanism that works in the chosen medium such as a snap-on fit with plastics wherein each of the two components, the container and the accessory each contain one of the mating components.

In one embodiment, the linking mechanism may include a child-proof twisting mechanism common in medicine bottle screw tops.

In one embodiment, the linking mechanism will secure the individual beverage container accessory to the individual beverage container in a secure and sanitary fashion.

In one embodiment, the individual beverage container accessory (2) will be made from a material that is identical to or similar to the material of the individual beverage container (1). Examples of materials include food grade plastics, metals, glass and coated paper, capable of handling beverages at consumable cold and hot temperatures. In an alternative embodiment, the individual beverage container accessory will be made from a material that is different from the material of the individual beverage container in that the container may already exist and, for example, be made of glass or aluminum, and it is desirable to manufacture the accessory out of plastic and in addition to the other functions of the accessory as described herein, it may also add an additional function of protection.

In one embodiment, the linking ring (9) is configured to snugly fit over an existing individual beverage container at some predefined point between the top and the bottom of the container, and have a smooth inner surface that fully affixes and forms a tight seal against the outer surface of the container at its attachment point.

In one embodiment, the linking ring (9) has an upper flat outer portion and then counterpart male or female screw threads concentrically downward from the flat portion. In this embodiment, the inner surface of the linking ring is flat and fits in full contact with the outer surface of the individual beverage container (1) and is capable of being secured in place with glue, bonding or some manner known in the art for securing plastic to plastic or metal to metal or plastic to metal or whatever material is chosen to manufacture the linking ring out of and the material of the container and form a tight, sanitary seal.

In one embodiment, the material from which the individual beverage container accessory is manufactured is recyclable. In one embodiment, the individual beverage container accessory, the individual beverage container and the linking ring are all manufactured from recyclable materials.

In one embodiment, the individual beverage container accessory (2) is configured with markings so as to indicate volume when filled with liquids.

In one embodiment, the individual beverage container accessory (2) will be constructed such that its open top edge when removed from the individual beverage container is thick enough so as to not be a cutting hazard.

In one embodiment, the individual beverage container (1) will be configured with a cap (3) that screws on and off of the container. In prior art, in one embodiment, the cap (3) will have ridges that make gripping the cap easier to facilitate screwing on or off. In one embodiment, the cap (3) will be constructed with nubs (4) that are smooth and rounded and small enough to feel like a non-harsh textured surface, but large enough to provide a grip area to further facilitate screwing the cap on or off.

In one embodiment, the individual beverage container cap (3) will have a plurality of nubs (4), spaced to ergonomically fit a typical user's thumb and pointer finger and in one embodiment, may have indents (18) for the thumb and pointer finger to grip to turn the cap either clockwise or counter-clockwise with ease. In one embodiment, there could be any number of nubs. In one embodiment, the nubs could be evenly spaced around the perimeter of the cap. (See FIGS. 11A, 11B, and 11C). In one embodiment, there could be at least two nubs spaced approximately ninety degrees apart from one another to accommodate a thumb and forefinger, irrespective of whether there were other nubs present or not. In one embodiment, there could be at least two nubs spaced one hundred eighty degrees apart from one another to accommodate a thumb and forefinger, irrespective of whether there were other nubs present or not. In one embodiment, there could be at least two nubs spaced some pre-chosen specific degree amount apart from one another to accommodate a thumb and forefinger, irrespective of whether there were other nubs present or not, and not necessarily equally spaced around the circumference of the cap. The nub spacing should be kept such that the ergonomic feature of making the cap easier to open and close is retained.

In one embodiment, the nubs (4) will also have a nub scratcher portion (20) that will serve as the writing implement in the labeling system describe elsewhere herein. In this embodiment, the nubs should protrude far enough out to facilitate the writing without being so far protruding as to make the nubs an annoyance in holding the container. In this embodiment, the nubs should have a rounded head (20) and should be equal to or have a less pointed head surface than that of a stylus as used in conjunction with computer touch initiated surfaces.

In one embodiment, where the individual beverage container is a can, typically an aluminum 10 oz soda or beer can with a pull tab to open, a proprietary snap-on cover (11) is fitted and configured to snap on and off the top off the can either before or after the pull tab has been opened, this providing a cap for an opened can, and a protective sanitary cover for an unopened can. In this embodiment, nubs (4) can be provided on the circumference of this cover (11) as disclosed elsewhere herein for nubs on a cap and can both facilitate the opening and closing of the can, as well as serve as the writing nubs for a labeling system as described below.

In one embodiment, the individual beverage container (1) and the individual beverage container accessory (2) contains an area where the material from which it is manufactured is prepared in a manner designed to allow writing with an ordinary pen or pencil or marker to easily adhere (5). In one embodiment, such preparation may be in the form of brushing, or etching or placing a second material over the first material.

In an alternate embodiment, the individual beverage container (1) and the individual beverage container accessory (2) contains an area where the material from which it is manufactured is prepared in a manner designed to accept the labeling system as described elsewhere herein.

In one embodiment, the individual beverage container accessory contains an area where it is configured to contain writing or other form of advertising.

In one embodiment, the individual beverage container (1) contains an area below where the linking ring (9) is affixed where the material from which it is manufactured is prepared in a manner designed to allow writing with an ordinary pen or pencil or marker to easily adhere such as described above in the case of preparing the accessory.

In one embodiment, the individual beverage container (1) contains an area below where the linking ring (9) is affixed where it is configured to contain writing or other form of advertising.

In one embodiment, when the individual beverage container accessory (2) is affixed to the individual beverage container (1) via the linking ring (9, 10), the unit as a whole is configured so as to be capable of bulk packaging into boxes and cases just as the individual beverage container (1) was prior to the addition of the accessory (2) and linking ring (9, 10) and adds insignificant weight, height or other footprint to the overall unit.

In alternate embodiments, where it is described above that the individual beverage container and/or individual beverage container accessory may contain brushed area for accepting writing, this may be replaced with the labeling system as described below.

In one embodiment, the individual beverage container and/or individual beverage container accessory may be constructed to accept a proprietary labeling system comprising a permanent subsurface (13) adhered to the individual beverage container (1) and/or individual beverage container accessory (2), as applicable, said subsurface (13) configured to accept any number of colors as a permanent color layer (14) and further configured to accept an outer coating (15) of a contrasting color or number of colors that resist smudging or smearing or dissolving, but that can be scratched off without damaging the permanent underneath color layer (14).

In one embodiment, the subsurface (13) just described is coated with a permanent layer of a rainbow of colors (14) and overcoated with a pure black layer (15). When the black layer is scratched, the undercoat of rainbow colors is exposed just where the scratching occurs and in this manner, any type of written message may be scratched into the label. (See FIG. 16).

In one embodiment, the overall writing surface is smooth and the nub scratching point (19) of the cap can be utilized as a scratching point to write on the label. In one embodiment, the writing surface will not smear, smudge, dissolve with moisture, or otherwise be affected by temperature or liquids and remain in place under all typical circumstances that would be encountered by an individual beverage container, and only when scratched, reveal the undercoating layer.

In one embodiment, the overcoating layer (15) may comprise an advertising message or trademark of an advertiser or the beverage manufacturer. In one embodiment, the permanent under layer (14) may comprise an advertising message or trademark or an advertiser or the beverage manufacturer.

In one embodiment, the writing surface will exist on an area on the individual beverage container and an area on the individual beverage container accessory (5), such that when the individual beverage container accessory is attached to the individual beverage container, it will appear as one contiguous label, but when the components are apart, may appear as two separate labels.

In one preferred embodiment, a label should span approximately 2.25 inches horizontally across the individual beverage container and be in total, approximately 2.5 inches in height. In one embodiment, the 2.5 inches in height is split across the individual beverage container and the individual beverage container accessory. In this embodiment, when the individual beverage container accessory is in place on the individual beverage container, the label appears as one contiguous label.

In one embodiment, the writing surface is substantially impervious to water, temperature, air, finger smudges, and the like.

In one embodiment, the outer writing surface color is black, white, or some graphic of an advertiser.

In one embodiment, there could be a tab (7) on a sheath seal (6) over the writing surface that must be pulled back to expose the writing surface and could also function as a peel off ticket or coupon or utilized for an additional identifying promotional purpose. In one embodiment, there is a tamper evident clear wrap encircling the entire circumference of the individual beverage container and covering the entirety of any writing label surface thereby protecting the label from any premature scratching prior to tearing off this covering and also acts as a security seal for the individual beverage container accessory.

In one embodiment, half of the overall label is on the individual beverage container and half on the individual beverage container accessory. In other embodiments. any portion of the label could exist on the container or the accessory.

In one embodiment where the individual beverage container accessory is a cup, it is designed with softened and/or beveled edges so as not to be sharp.

In one embodiment, based on where the linking ring is designed to be placed on the individual beverage container, the relative height of the individual beverage container accessory is varied accordingly and thus, the overall volume capacity of the accessory can be manipulated.

In one embodiment, the linking ring can be manufactured in any diameter and from a variety of materials so as to be adjustable for use with any size and any material individual beverage container.

In one embodiment, a second added individual beverage container accessory configured as a storage component may be added at the neck of the individual beverage container so as to contain an additive desired to be mixed with the contained beverage at the time of consumption. In this embodiment, a simple twist of the neck area will puncture a temporary seal between the storage component and the beverage contained within the individual beverage container allowing the additive to drop into and mix with the beverage prior to taking off the cap of the individual beverage container. In this embodiment, there may be two additional embodiments, one where the added neck storage accessory remains in place and to reseal the individual beverage container, simply refit the cap; and a second embodiment where the added neck storage container breaks off completely after twisting and the cap is fitted to reseal at a position below the added neck storage accessory. In this embodiment, the embodiment of having a plurality of nubs positioned on the cap may be especially important.

In an alternative embodiment, principles of design as described elsewhere herein may be utilized to construct an individual beverage container that has additional components and areas of storage to implement common pairings of liquid and dry goods. For example, a two-part individual beverage container accessory may be constructed wherein one section, in this example, the lower and upside down section, contains dry goods such as cereal. The upper section contains the liquid such as milk. The two sections are joined by a linking ring and otherwise individually sealed in a conventional manner. The entire unit may be refrigerated to preserve the liquid portion and when a user wants to consume, they unscrew the two sections, upright the lower section that has the dry ingredient and unseal, unseal the top portion that contains the liquid and use. The entire unit is then resealable and reconnectable, if desired.

In one embodiment, the individual beverage container accessory may also comprise a cover. In one embodiment, the cover will be sold with the overall unit attached over the individual beverage container accessory much in the same manner as the individual beverage container accessory is attached over the individual beverage container, again without significantly increasing the overall footprint or size of the complete unit. In this embodiment, when the individual beverage container accessory is removed from its position on the individual beverage container, this cover can be then removed from the individual beverage container accessory and function as a cover for the individual beverage container accessory, replaceable and removable such that it becomes a separate covered cup or bowl. In a preferred embodiment, the cover when attached for sale to the individual beverage container accessory, it is of a preconfigured height so as not to interfere with the exposed surface of the labeling system described elsewhere herein. In one embodiment, the cover may fit over the individual beverage container accessory and sit in place through friction. In an alternative embodiment, where the individual beverage container accessory attaches to the individual beverage container via a linking ring containing threads, threads of a similar nature could be configured onto the cover and utilized for linking the cover over the top of the individual beverage container accessory. In an alternative embodiment, the cover could be configured with a snap-on/snap-off component.

DETAILED DESCRIPTION

Figure 1:
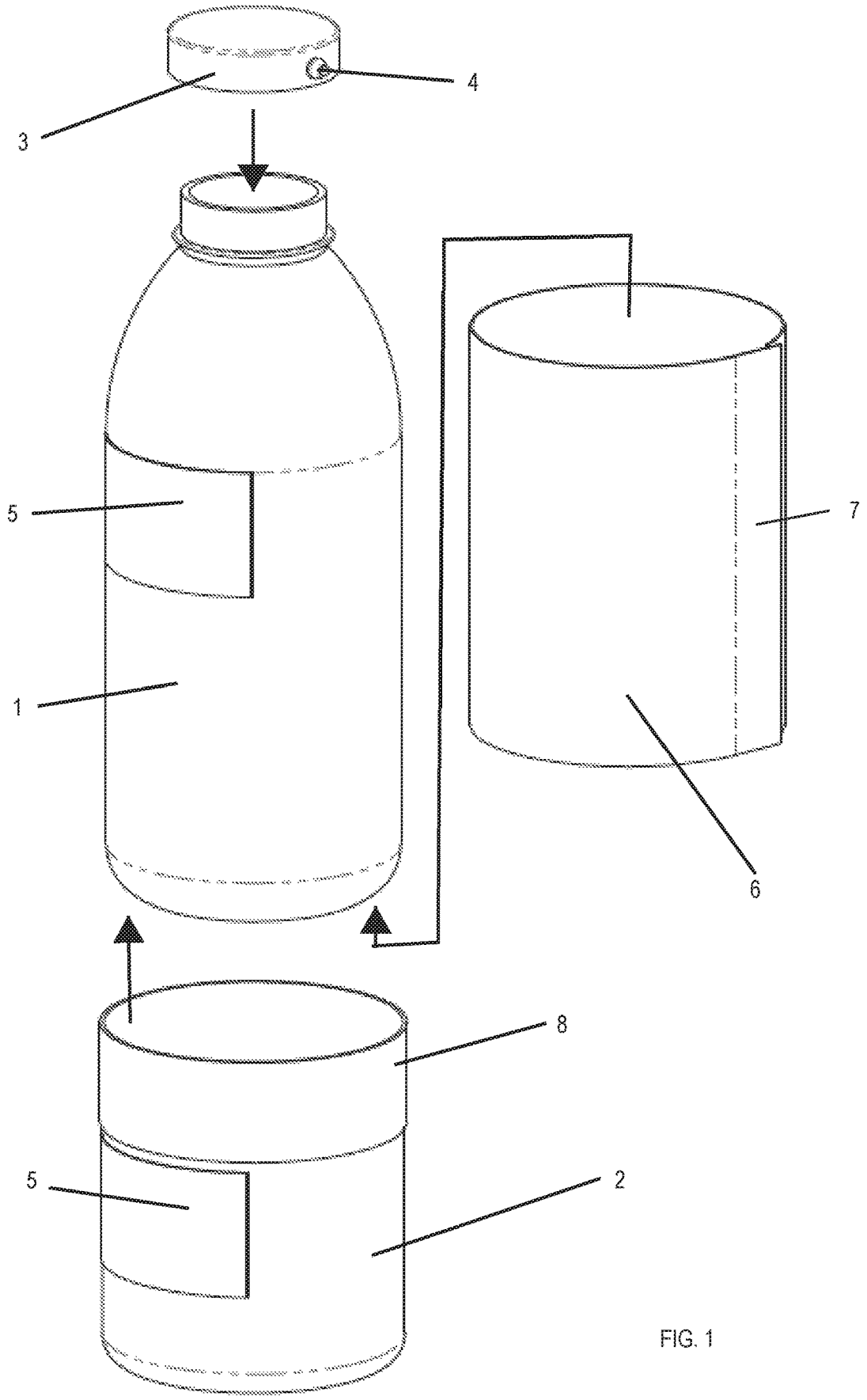
FIG. 1 depicts one embodiment of an individual beverage container configured to receive an individual beverage container accessory, a cap, a proprietary labeling system on both the individual beverage container and the individual beverage container accessory and then sealed with a tamper evident protective covering with an easy removal tab.
Figure 2:
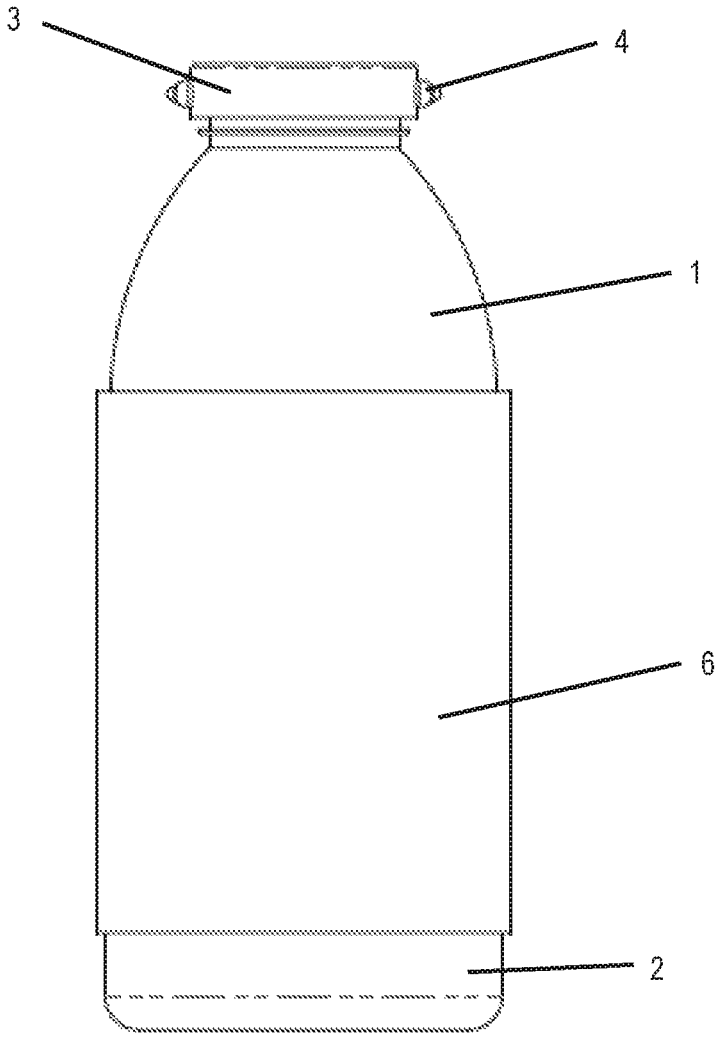
FIG. 2 depicts one embodiment of a frontal view of an individual beverage container with an individual beverage container accessory fitted in place, a cap secured in place, and a proprietary labeling system covered and sealed with a tamper evident protective covering with an easy removal tab (not shown).
Figure 3:
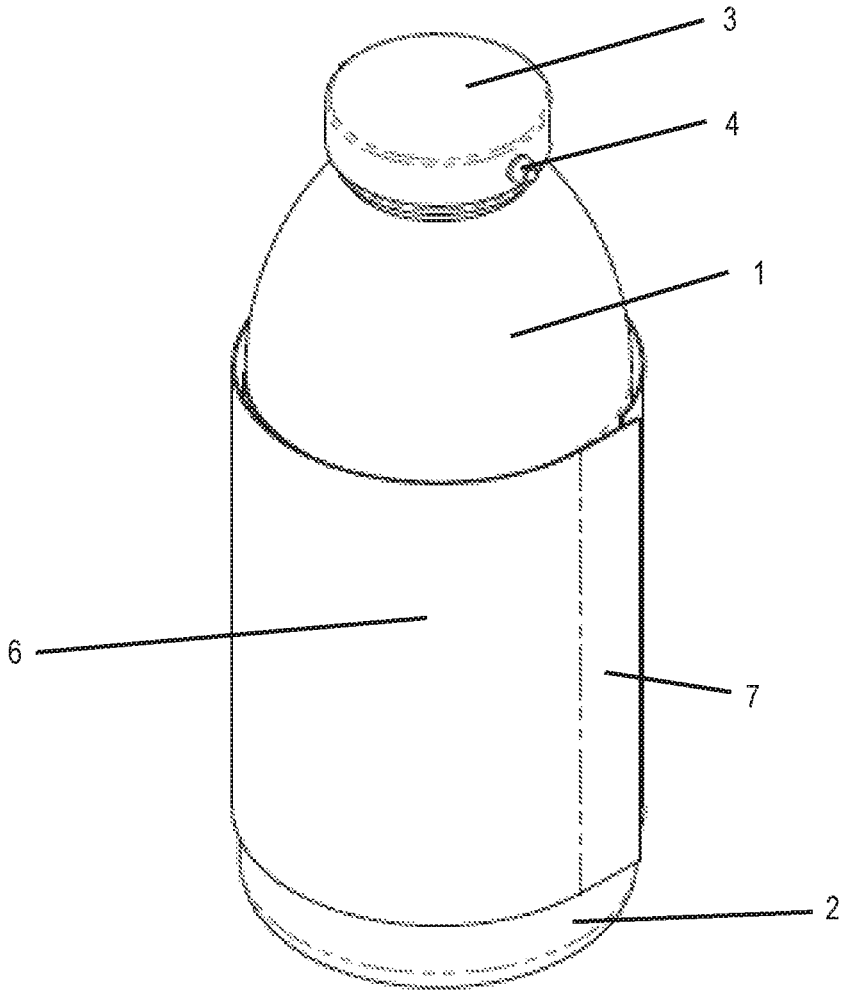
FIG. 3 depicts one embodiment of a perspective view of an individual beverage container with an individual beverage container accessory fitted in place, a cap secured in place, and a proprietary labeling system covered and sealed with a tamper evident protective covering with an easy removal tab.
Figure 4:
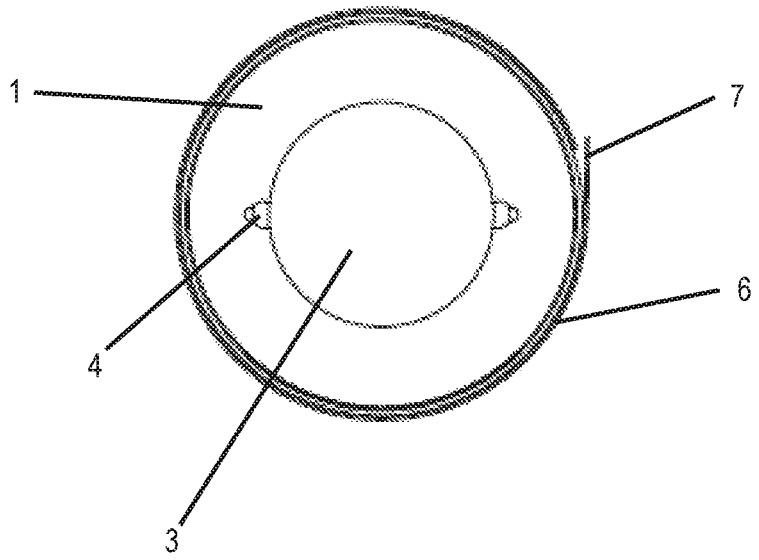
FIG. 4 depicts one embodiment of a top view of an individual beverage container with an individual beverage container accessory fitted in place (not shown as it is underneath), a cap secured in place, and a proprietary labeling system covered and sealed with a tamper evident protective covering with an easy removal tab.
Figure 5:
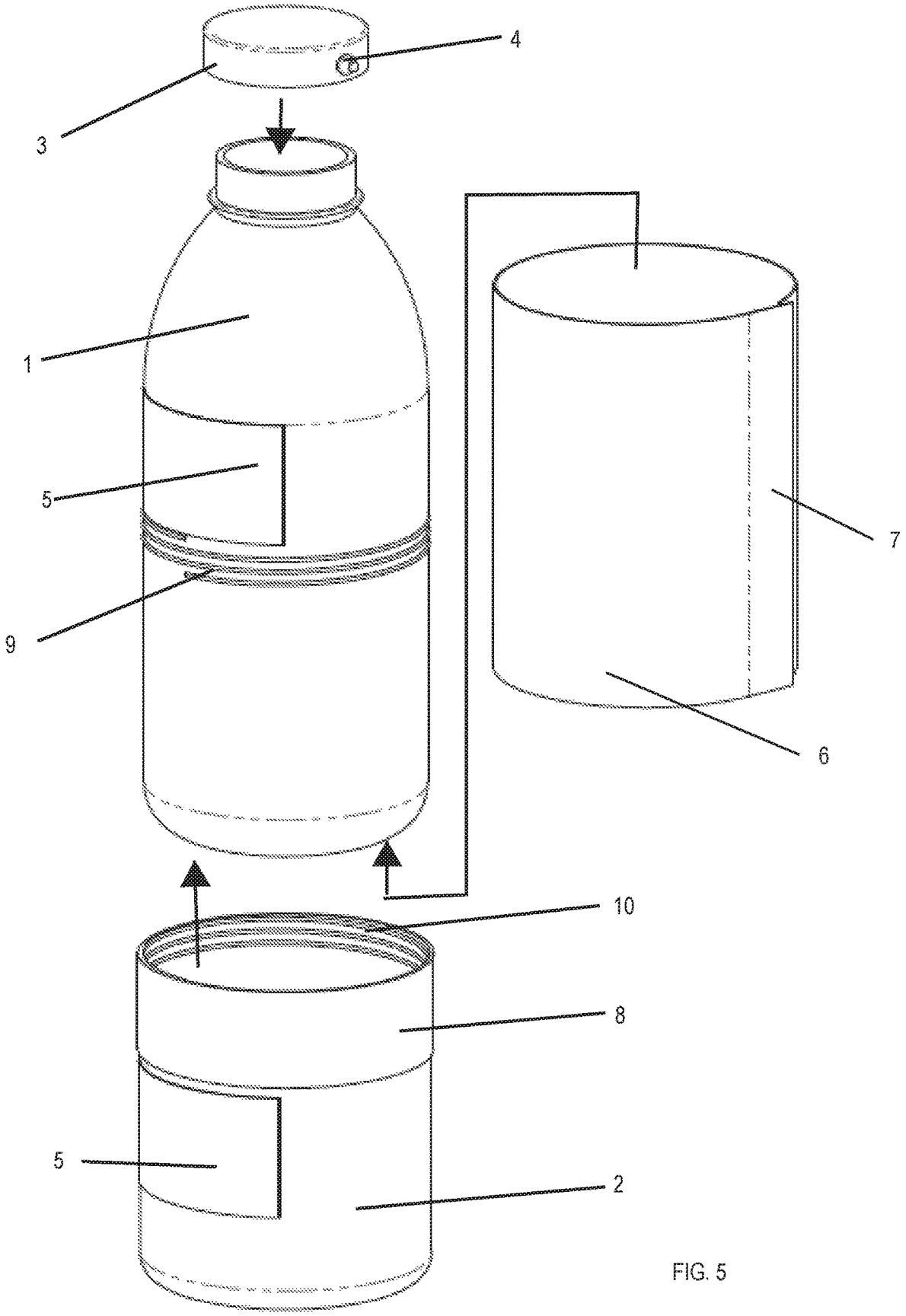
FIG. 5 depicts one embodiment of an individual beverage container configured to receive an individual beverage container accessory, and link via a linking means other than just simple friction, a cap, a proprietary labeling system on both the individual beverage container and the individual beverage container accessory and then sealed with a tamper evident protective covering with an easy removal tab.
Figure 6:
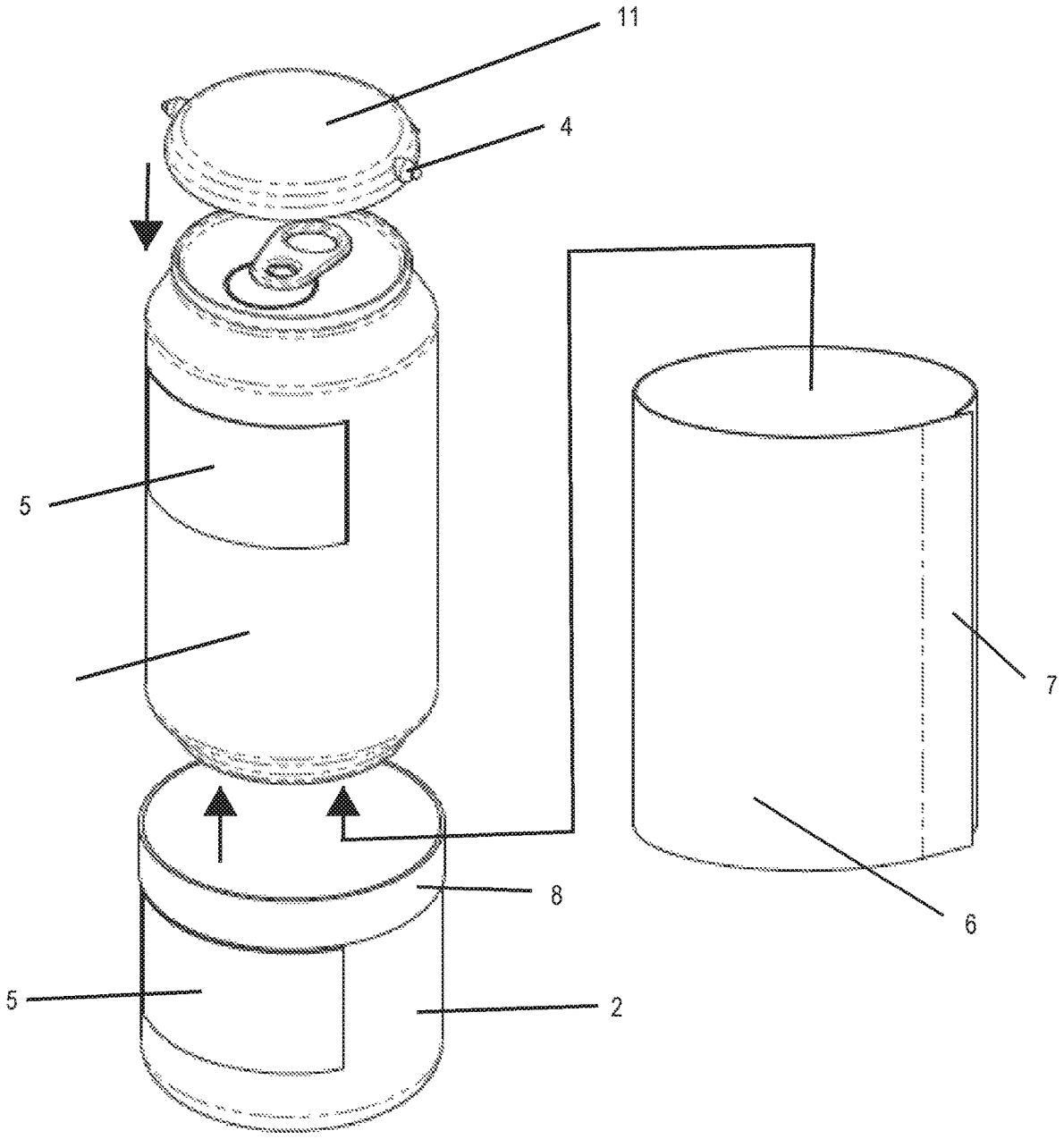
FIG. 6 depicts one embodiment of an individual beverage container wherein such container is a typical beverage can, configured to receive an individual beverage container accessory, a cap configured to snap on and off of the can top, a proprietary labeling system on both the individual beverage container and the individual beverage container accessory and then sealed with a tamper evident protective covering with an easy removal tab.
Figure 7:
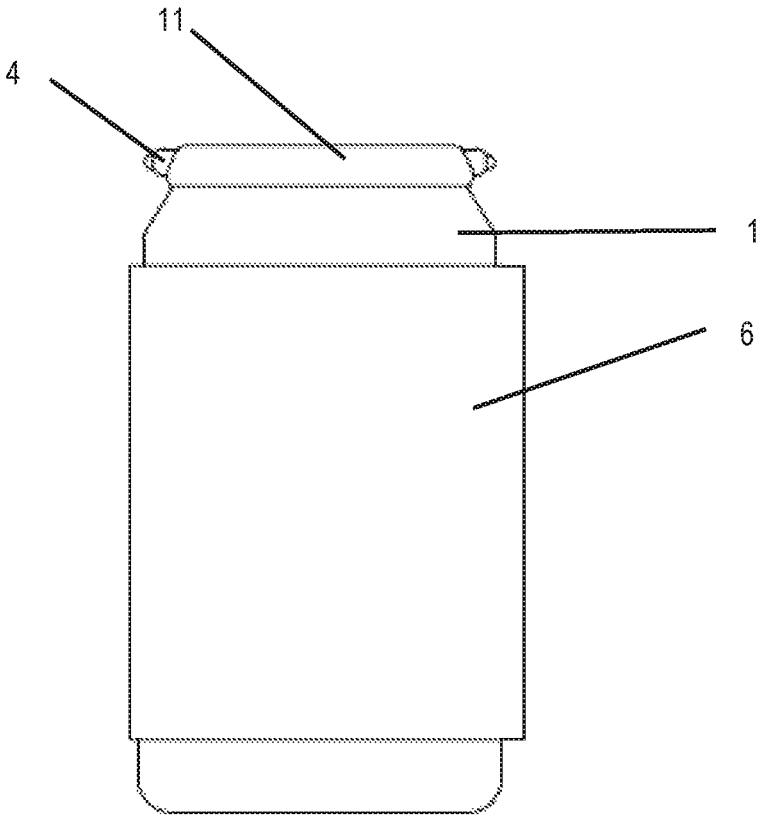
FIG. 7 depicts one embodiment of a frontal view of an individual beverage container wherein such container is a typical beverage can, with an individual beverage container accessory fitted in place, a cap secured in place, and a proprietary labeling system covered and sealed with a tamper evident protective covering with an easy removal tab (not shown).
Figure 8:
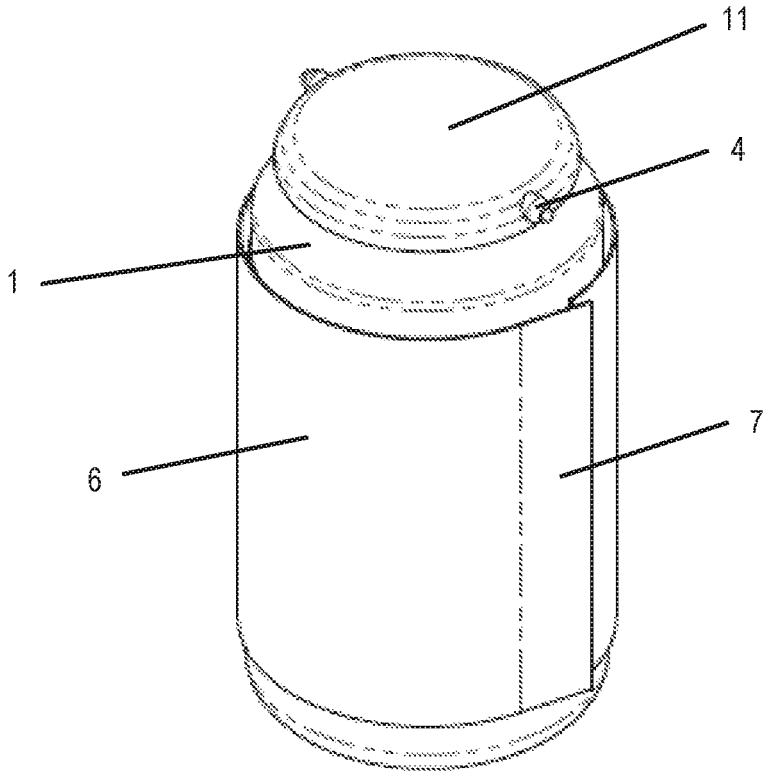
FIG. 8 depicts one embodiment of a perspective view of an individual beverage container wherein such container is a typical beverage can, with an individual beverage container accessory fitted in place, a cap secured in place, and a proprietary labeling system covered and sealed with a tamper evident protective covering with an easy removal tab.
Figure 9:
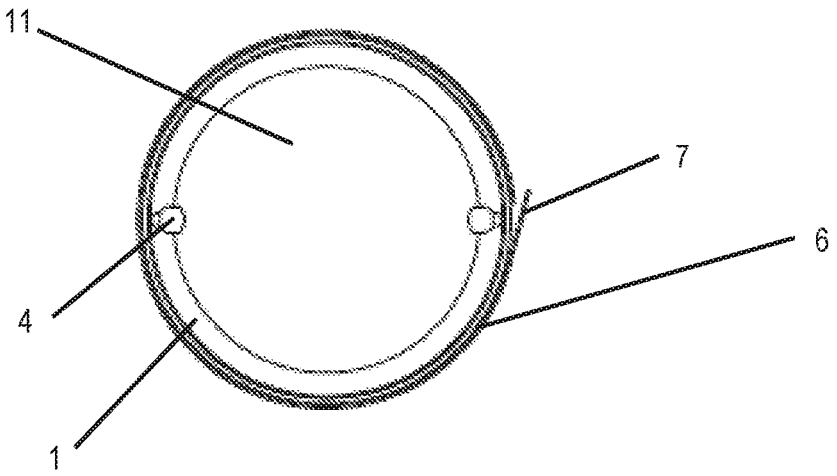
FIG. 9 depicts one embodiment of a top view of an individual beverage container wherein such container is a typical beverage can, with an individual beverage container accessory fitted in place (not shown as it is underneath), a cap secured in place, and a proprietary labeling system covered and sealed with a tamper evident protective covering with an easy removal tab.
Figure 10:
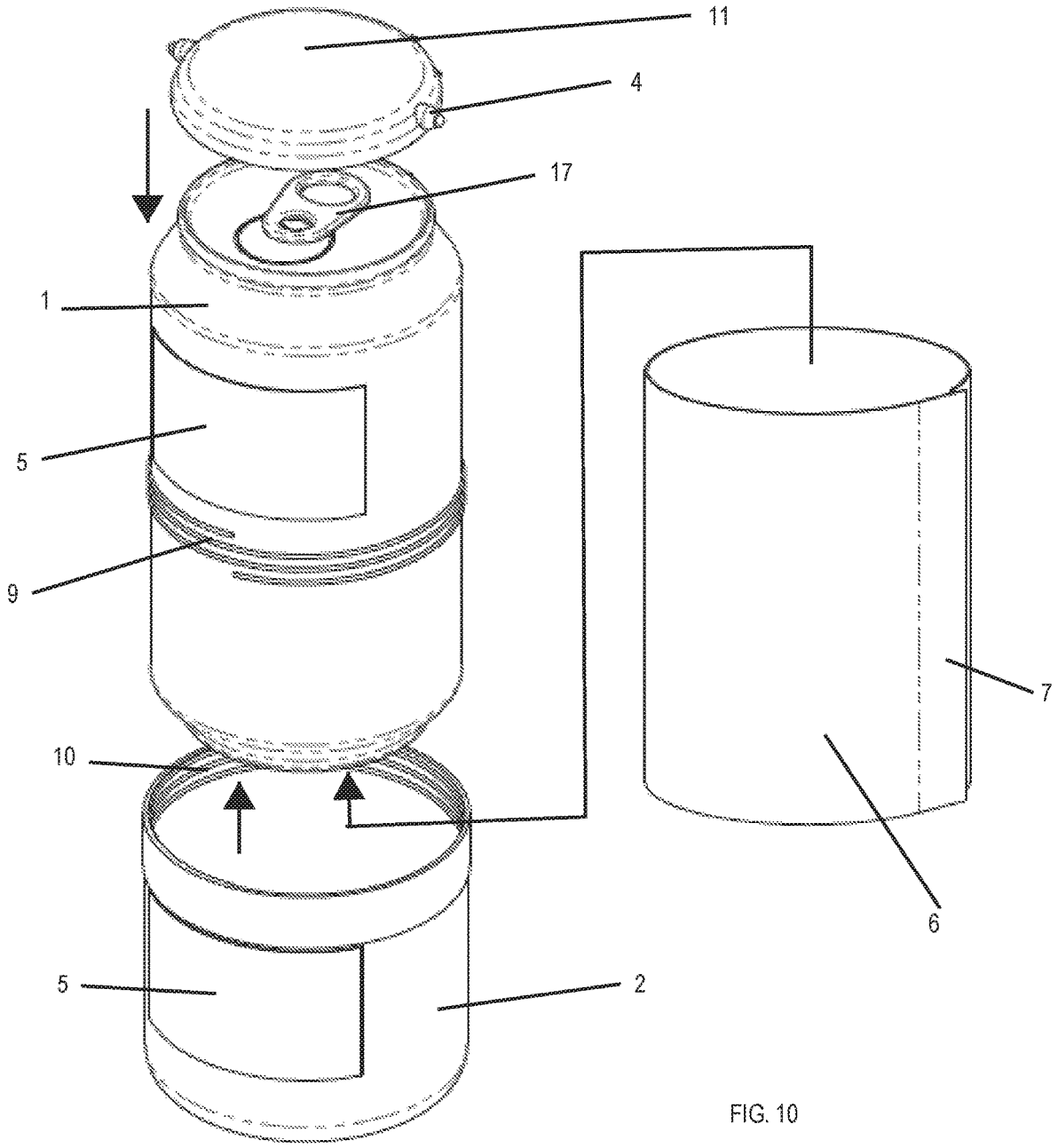
FIG. 10 depicts one embodiment of an individual beverage container wherein such container is a typical beverage can, configured to receive an individual beverage container accessory, and link via a linking means other than just simple friction, a cap, a proprietary labeling system on both the individual beverage container and the individual beverage container accessory and then sealed with a tamper evident protective covering with an easy removal tab.
Figure 11A:
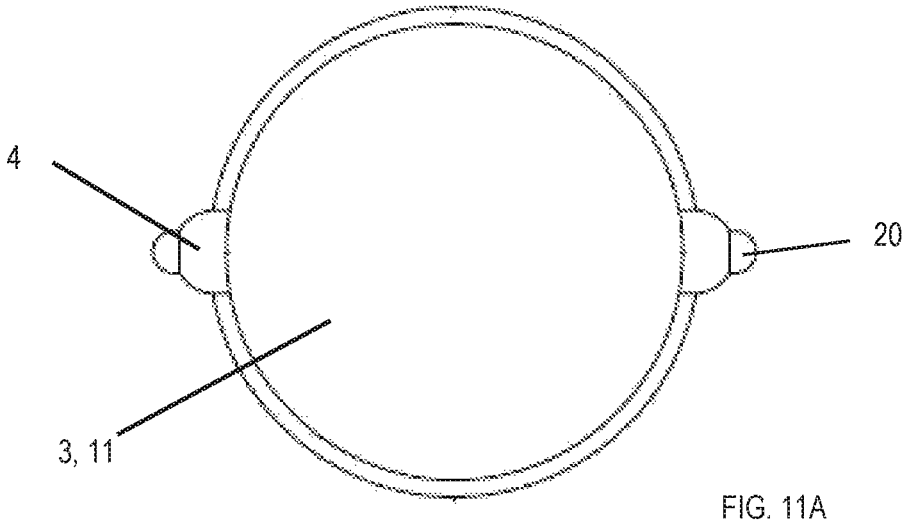
FIG. 11A depicts one embodiment of a top view of a cap configured to attach to an individual beverage container with one configuration of two nubs. On each nub, is a smaller scratching end surface utensil.
Figure 11B:
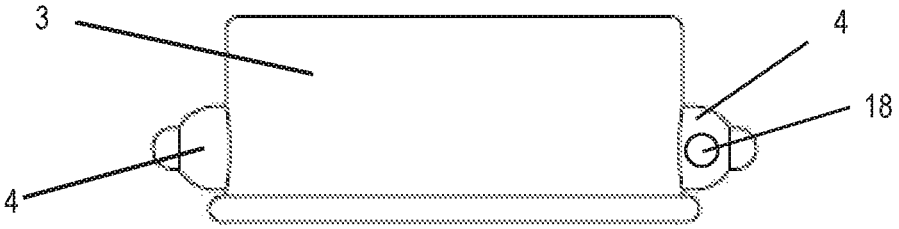
FIG. 11B depicts one embodiment of a side view of a cap configured to attach to an individual beverage container with one configuration of two nubs. In this embodiment, one of the nubs depicts a configuration of an indent that may be desired to make the nub more comfortable to a finger that would grip at that location.
Figure 11C:
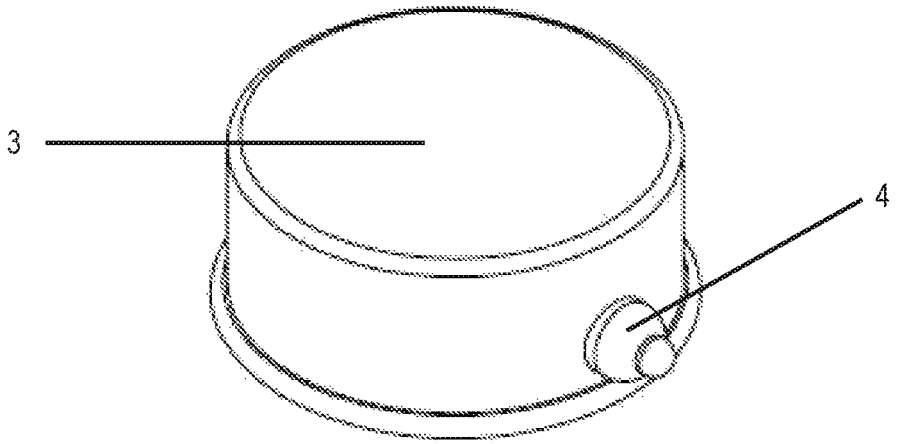
FIG. 11C depicts one embodiment of a perspective view of a cap configured to attach to an individual beverage container with one configuration of two nubs.
Figure 12A:
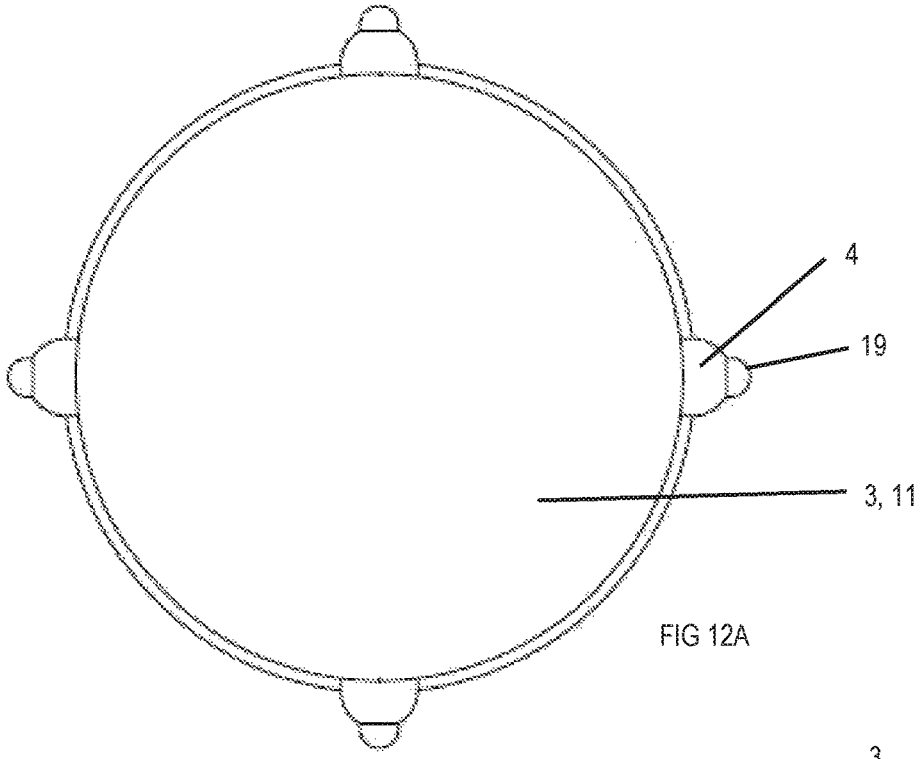
FIG. 12A depicts one embodiment of a top view of a cap configured to attach to an individual beverage container with one configuration of four nubs.
Figure 12B:
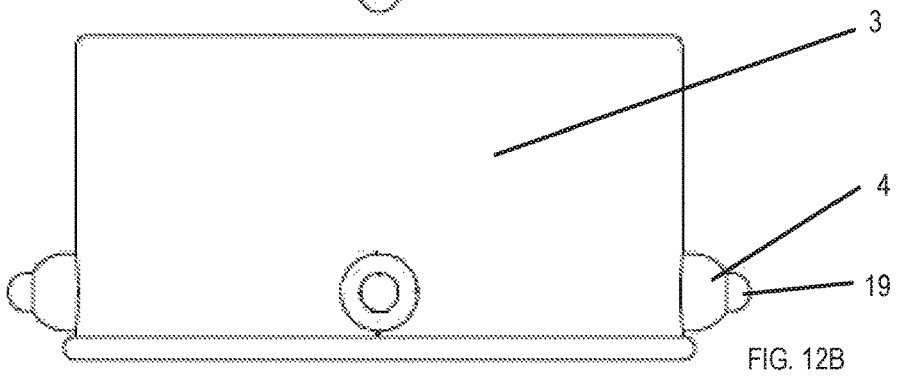
FIG. 12B depicts one embodiment of a side view of a cap configured to attach to an individual beverage container with one configuration of four nubs.
Figure 12C:
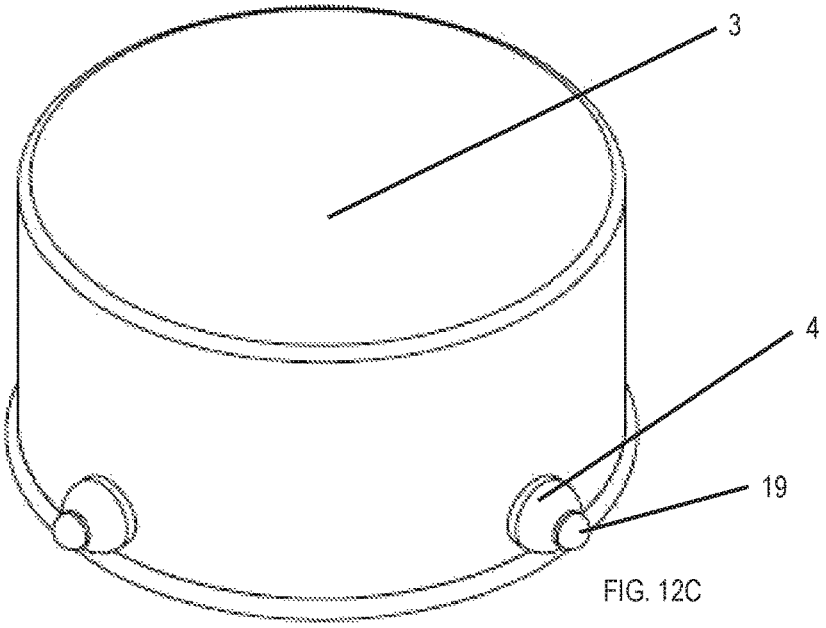
FIG. 12C depicts one embodiment of a perspective view of a cap configured to attach to an individual beverage container with one configuration of four nubs.
Figure 13A:
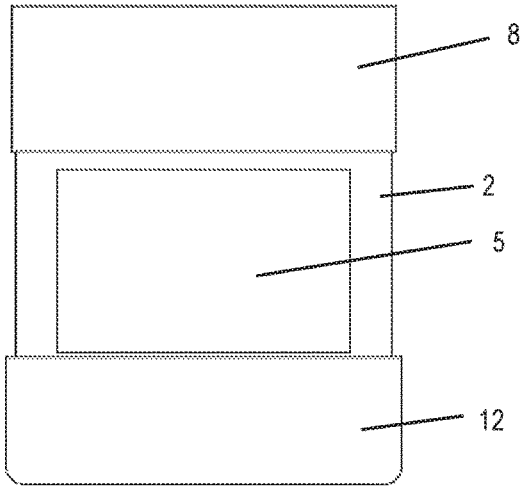
FIG. 13A depicts one embodiment of a frontal view of an individual beverage container accessory with an individual beverage container accessory cover fitted in place over the bottom of the individual beverage container accessory and ready for use.
Figure 13B:
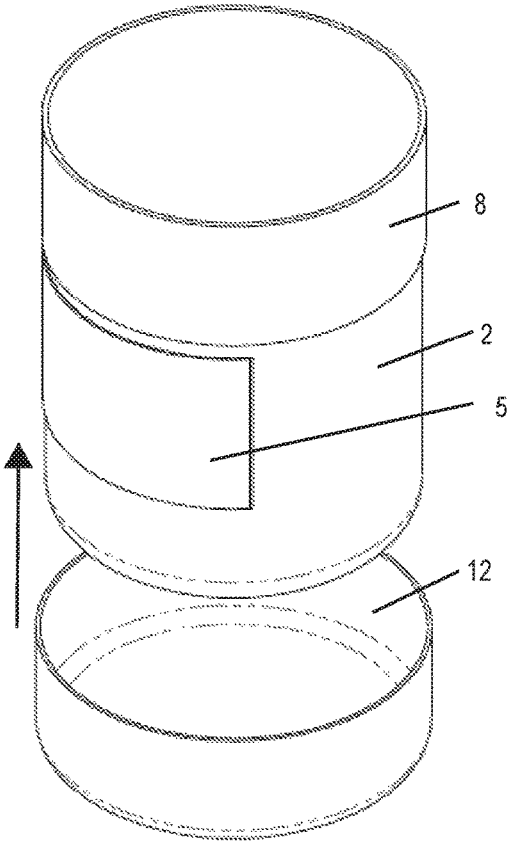
FIG. 13B depicts one embodiment of an exploded perspective view of an individual beverage container accessory with an individual beverage container accessory cover ready to be fitted in place over the bottom of the individual beverage container accessory and ready for use.
Figure 14A:
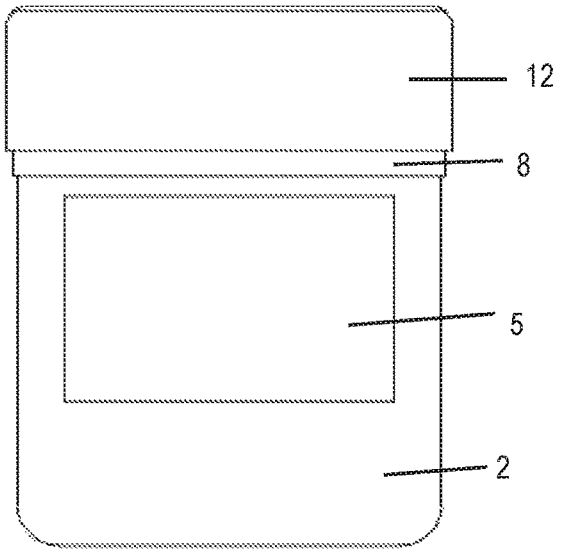
FIG. 14A depicts one embodiment of a frontal view of an individual beverage container accessory with an individual beverage container accessory cover fitted in place over the top of the individual beverage container accessory after it has been removed from its securement place over the bottom.
Figure 14B:
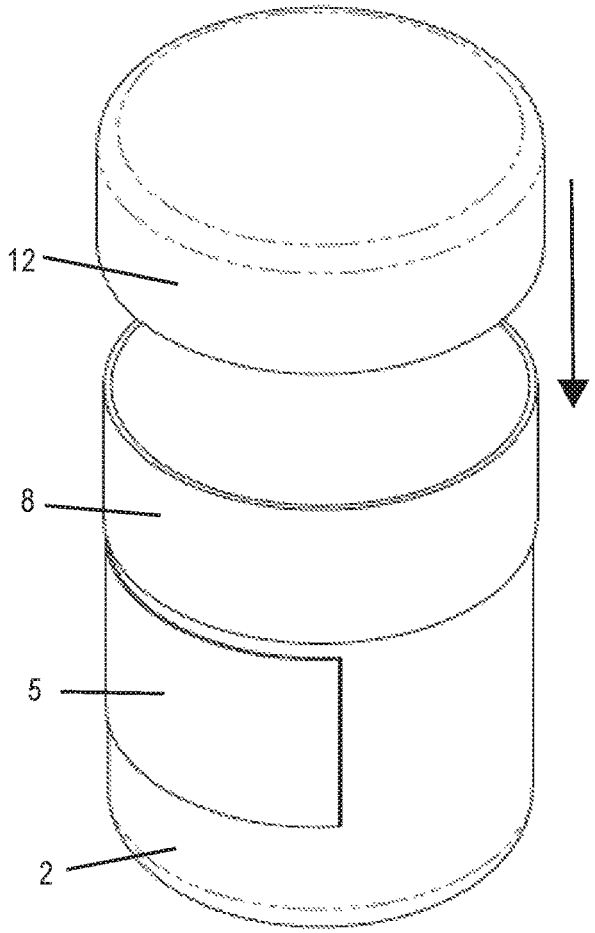
FIG. 14B depicts one embodiment of an exploded perspective view of an individual beverage container accessory with an individual beverage container accessory cover ready to be fitted in place over the top of the individual beverage container accessory.
Figure 15:
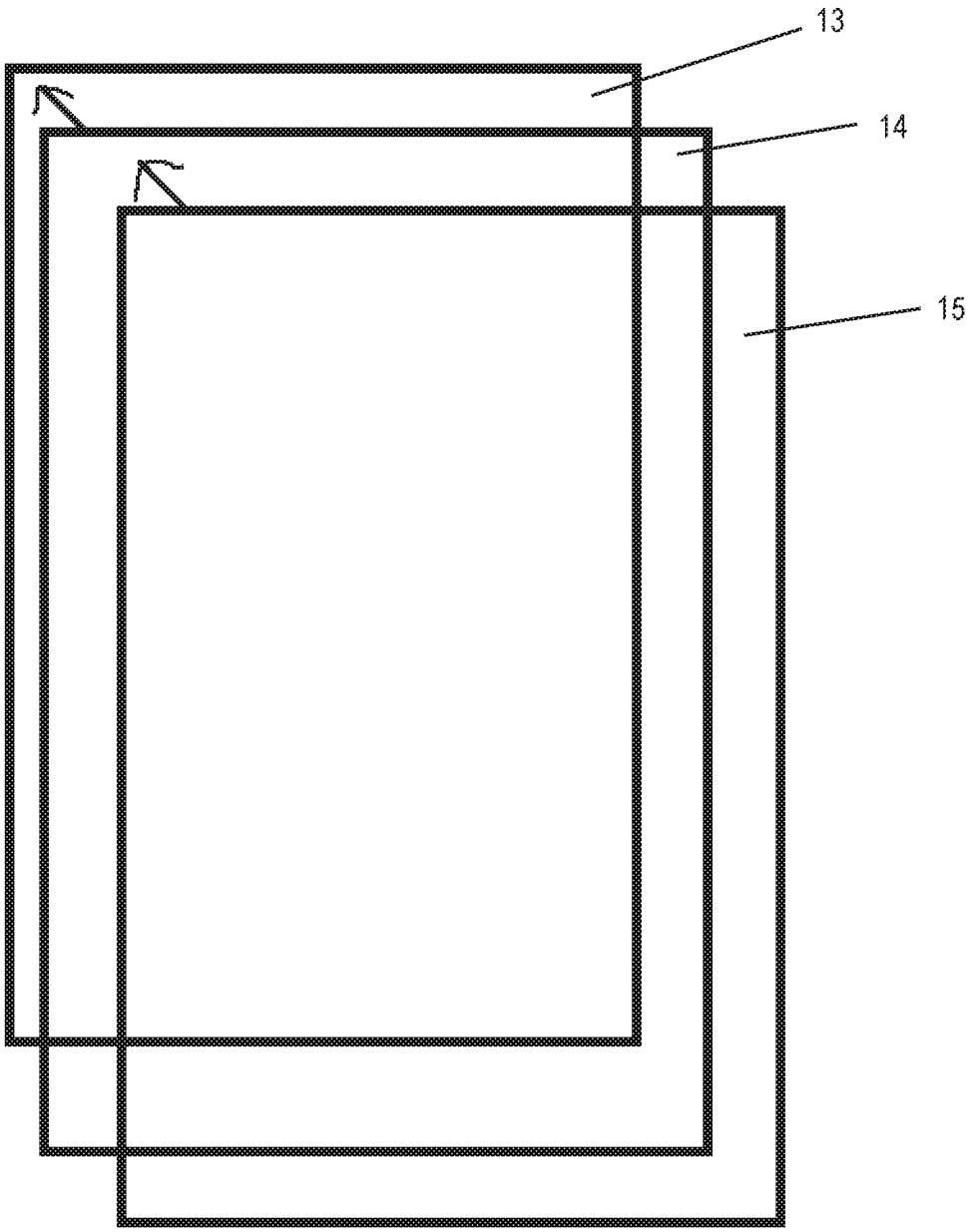
FIG. 15 depicts one embodiment of a configuration of a proprietary labeling system having three layers with a substrate layer configured to accept a middle color or contrast ink layer and further configured to accept a scratchable over layer in contrast to the the color or contrast middle layer that when in place and scratched, reveals the middle color or contrast layer only where the scratches are made.
Figure 16:
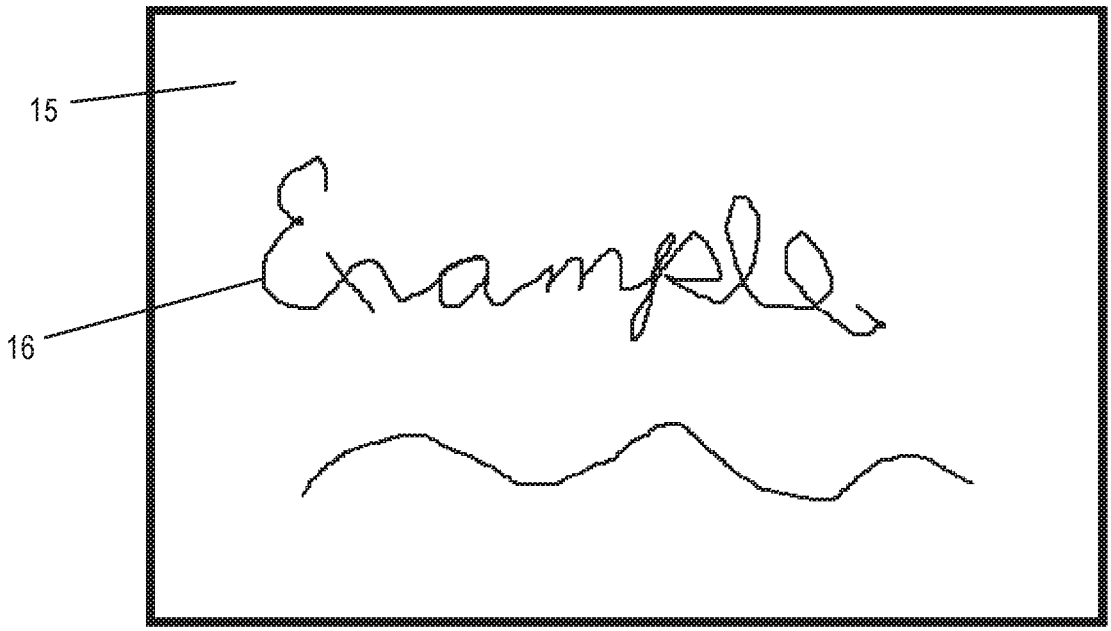
FIG. 16 depicts one embodiment of a proprietary labeling system with all of the layers intact and the top layer having been scratched with a nub revealing the middle contrast layer where the scratching occurred. Note that these are black and white line drawings such that the middle layer here is black and the scratchable overcoat layer is white, but any combination of contrasting colors could be used.

For clarity of disclosure, and not by way of limitation, the detailed description of the invention is divided into the following subsections that describe or illustrate certain features, embodiments or applications of the present invention.

Definitions

"individual beverage container" as used herein means a container commonly used to contain beverages such as water, soda, juices, beer and the like and commonly sold as individual units for individual consumption and typically have a round mid-section and made from glass, plastic or metal.

"individual beverage container accessory" as used herein means an accessory unit configured to be affixable to an individual beverage container via a linking ring.

"linking ring" as used herein means a ring either separately attached to or directly molded in and configured to be secured to the outer surface of an individual beverage container in a fully sealed in either a temporary or permanently affixed manner wherein the inner surface of said linking ring is smooth to form an airtight seal with an individual beverage container and the outer surface of said linking ring contains a linking mechanism configured to mate with and affix to the individual beverage container an individual beverage container accessory. Said linking ring mechanism generally contains two parts, namely a first component installed on an outer circumference of an individual beverage container configured to mate with a corresponding linking ring mate installed on the inner circumference near the mouth of an individual beverage container accessory, and the second component (which may be integral to and part of the first component, only separated here in concept) is the component that creates the seal that is airtight and sanitary. The actual mating of the linking ring and linking ring mate could occur in any number of ways, such as screwing threads together, snapping with one contiguous thread, frictional tight fitting surfaces, and any method now known or hereafter developed.

"linking ring mate" as used herein means a device either separately attached to or directly molded in an individual beverage container accessory that has corresponding mating and sealing mechanisms to attach to a linking ring.

"nub" as used herein is a small rounded protrusion formed in the cap of an individual beverage container and may contain indents to facilitate fingers using the nubs as leverage to twist open or closed the cap and also can have a rounded tip suitable for use as a writing implement to scratch off a top coating of a color coated label area.

"cap" as used herein means any device for closing or sealing an individual beverage container or any other type of container, bottle, can, or carton and may affix to such container in any known manner, including but not limited to screwing on and off, snapping on and off, and fitting tightly via friction.

"proprietary labeling system" as used herein means any layered scratchable writing means comprising at least a substrate layer, a permanent middle layer comprising the coloring of the desired writing to be exposed, and a scratchable overcoat layer of contrasting color to the permanent middle layer, scratchable with a nub, and the entire label configured to be suitable for use with containers that will be sometimes warm, sometimes chilled and capable of exposure to liquids.

The System and Method of the Present Invention

A typical installation as described herein is to affix a linking ring (9) at a predetermined place along the midsection of an individual beverage container (1) placed according to the size and specifically the height of an individual beverage container accessory (2) that is desired to be used. The linking ring that contains screw threads is permanently affixed in place such that a full seal is formed between the inner surface of the linking ring and the outer surface of the individual beverage container. In an alternative embodiment, the individual beverage container could be form molded to already contain the linking ring as one contiguous unit.

Once an individual beverage container (1) exists with an affixed linking ring (9), an individual beverage container accessory (2), such as one configured to be a cup, is further configured to be a size that will easily but just fit over the outer surface of the prepared individual beverage container and is further configured to contain a linking ring mate (10) on its inner upper surface such that when the accessory is slipped over the container, it can screw into place and be securely affixed and sealed.

In a typical embodiment, the cap (3) of the individual beverage container is also fashioned containing at least two nubs (4), ninety degrees apart from one another or one hundred eighty degrees apart from one another to facilitate a user opening and closing the container. In this embodiment, a labeling area (5) is prepared where a part of the surface of the individual beverage container an inch or two from and including the linking ring is prepared with a subsurface (13) to accept a permanent layer of colorant (14) and a scratchable overlayer (15) of a contrasting colorant and those layers applied. The same preparation and colorant layers are added to the individual beverage container accessory in such a manner that when attached, the label areas match up and appear as one contiguous label and this label is also scratchable with the nubs on the container cap.

Scratchboard art is not generally a new concept and is a form of direct engraving where a person scratches off an ink layer fashioned over an under contrasting ink layer to expose the under color through the contrasting over layer. Typically, an underlayer of some desired color, or colors, of ink is permanently affixed to a substrate such as paper, and then an overlayer of a contrasting color, typically black, is placed over the underlayer. This overlayer must have only semi-permanent properties such that it can be scratched through with a knife, or nail, or other instrument without harming or removing the underlayer, thereby exposing the underlayer. Here, to be appropriate for use on an individual beverage container, there are necessary considerations of moisture and temperature affecting the various layers. Typical scratchboard paper is unsuitable because the paper may get saturated with condensation, or weak and messy from temperature and moisture conditions commonly encountered in the distribution and use of such containers.

In one embodiment, scratchboard may be made by any artist with white card stock, dish soap, wax paper, oil pastels, and black poster paint. First lay the card stock on top of the wax paper and use the oil pastels of varying colors to color the white card stock in any desired manner. Add a small amount of dish soap to the black poster paint and use the mixture to cover entirely the colored card stock. The dish soap facilitates the poster paint sticking to the oil pastel, but the poster paint retains the properties of being just brittle enough to be scratched off leaving the oil pastel underneath undisturbed.

In one embodiment, a scratchboard application suitable for use in the present application is to prepare the surface area of an individual beverage container and/or an individual beverage container accessory, to accept an application of a desired color or colors of ink to be a permanent application impervious to liquid and unaffected by temperature. Such treatment and application and choice of materials will vary by the material of the underlying container or accessory. Oil based paint may work on glass, whereas other materials known to those skilled in the art may be a more suitable choice for plastic containers. Once the color underlayer is applied, a second, contrasting, color or colors is applied as an overlayer and chosen also to be impervious to liquid and unaffected by temperature but with properties allowing it to be scratched off of the underlayer without affecting the underlayer with a plastic nub. In one embodiment, all of the layers in this application will be polymer based and comprise the waterproof properties and temperature insensitivity desirable for application directly to plastics or metal or glass.

In an alternative embodiment, a scratchboard application suitable for use in the present application is to first prepare an independent label apart from the individual beverage container or individual beverage container accessory and then use an adhesive to apply the label as desired. In this embodiment, the only difference from the foregoing direct application is that a substrate layer is chosen, again, typically a polymer layer for its properties with respect to moisture and temperature, but chosen also for tensile strength for applying the underlayer and overlayer and withstanding the manufacturing process, the application with adhesive to the container, and the scratching by the user. In this manner, large sheets can be manufactured and cut and applied as desired and no special preparation of the container surface need be undertaken as those surfaces are already manufactured to be able to have labeling applied and the scratchboard pieces as desired may simply form a part of the labeling.

In one embodiment, no matter the method chosen to apply the scratchboard application to the individual beverage container or accessory, an over label may be applied to protect, hide, or otherwise provide an additional branding, message or coupon to the user/purchaser.

In one embodiment, once the individual beverage container accessory is securely affixed in place to the individual beverage container, the seal formed at the linking ring area between the individual beverage container and the individual beverage container accessory may be sanitarily sealed until use by placing a tamper evident plastic sheath around the seal. In one embodiment, this sheath may also act as a label covering tab and may be used as a ticket or coupon that upon pulling off is used, and also exposing the scratchboard area.

EXAMPLES

The present invention is further illustrated, but not limited by, the following examples.

A typical use of the prior description is that a consumer desires to purchase a container of some beverage such as water or juice. A typical individual container of such a beverage may be twenty ounces which may be more than the consumer desires at that given time. The container typically contains a resealable cap meaning they could drink half and reseal and save the other half for later. However, typically, the consumer drinks directly out of the container. This is not sanitary. Moreover, the consumer may not have access to a refrigerated unit to store the container until the other half is desired to be consumed.

Thus, when the consumer goes to consume the other half, it will be warm and contaminated.

Through the teachings of this disclosure, there is a better way. In one embodiment, that same beverage container purchased by that consumer is first outfitted with a linking ring and an individual beverage container accessory configured to be a cup and sealed in a sanitary manner at the manufacturing level. Moreover, the cap is outfitted with nubs making the cap easier to take on and off. There is also placed a label on both the individual beverage container and the individual beverage container accessory. When the consumer purchases this now reconfigured beverage, he can break the seal and unscrew the cup accessory. He can now pour half of the contents of the container into the cup. If he has a friend who also only wanted approximately half of a twenty ounce container of beverage, he can share the beverage with that friend. Both will have their own drinking vessel and do not have to take swallows back and forth. Moreover, with the nubs on the cap, each of the two now separated components can be labeled as to whose is whose. Even in the event where there is still only one consumer, they can uncap the container and pour half its contents in the cup and immediately reseal keeping the unused portion uncontaminated and sanitary for later consumption. The container can also be marked as to when it was opened and the cup marked with the person's name who is using it.

There are alternative embodiments, as well. For example, the individual beverage container accessory could be configured as both a cup and a storage container. In this embodiment, the accessory could store a small sachet of flavoring or nutrient that, upon opening, could be introduced into the beverage, such as flavorings for water or nutrient boosters for body builders. Such sachets of flavors or nutrients are generally extremely small and compact and would require no additional configuration, or perhaps at most, a millimeter or two of extra height configured in the accessory cup.

In another example, the area of labeling to accept writing could be configured with scratch off games for prize giveaways, advertising or other functions.

In another example, the individual beverage container accessory could be configured as both a cup and a storage container so that a breakfast could be made. For example, the accessory could store instant oatmeal. Add the beverage and microwave into an instant hot meal, i.e., in this embodiment the accessory is a bowl. In that same vein, the accessory could be a bowl and the beverage could be milk and it could work with cold cereal.

In another embodiment, the individual beverage container accessory could be utilized for snacks such as cereal, pretzels, crackers, chips and the like. Thus, some of the item could be poured out of the bigger bag into the accessory cup eliminating the need for reaching into the bag each time someone wants to take some and ending cross-contamination issues.

In one embodiment, the pressure sensitive labeling system that is scratchable with the cap nub, could be utilized for advertising, i.e., for a school or professional sports franchise or other event, or many purposes simultaneously and the label creates a focal point for writing on its pressure sensitive surface.

In one embodiment, this container system uses adhesives that are non-toxic and are also readily disposable or recyclable. in one embodiment, this container system is break resistant, having been manufactured substantially from pliable plastics and polymers.

In one embodiment, the container system described herein are components merged into a singular, sanitary, unitary package, comprising a modified cap, an individual beverage container, and individual beverage container accessory, and an integrated labeling system having an ergonomic functionality and concealed, integrated labeling capability.

In one embodiment, the overlayer of colorant could be an embossing by a particular advertiser, sports franchise, or event sponsor that is then personalizable by the user.

In one embodiment, the cap comprising a plurality of nubs could be a stand-alone feature of any cap simply to create an ergonomic nub ring to ease the difficulty of opening almost any sized cap on a cylindrically shaped container comprising a twist off cap.

In one embodiment, where there is a cover utilized in conjunction with the individual beverage container accessory, this fitted and securable cover provides contents portability and safety from contamination. In this embodiment, there are additional surfaces that can be utilized with the proprietary labeling system, for example, without limitation, the underside that also functions as the top when in the covering orientation; or, the side similar to both the individual beverage container and the individual beverage container accessory that it covers.

In one embodiment, this combination of an individual beverage accessory and cover therefore, can be utilized for the sharing and personal labeling of snacks, nuts, raisins, berries, and the like. This combination could also be useful to its users as a small container for storing leftovers and labeling them. Alternatively, it could be useful for storing small objects such as screws, nails, nuts, bolts, and the like, or to store other small implements such as crayons or pencils. It could also serve as a great small container for the mixing of substances such as epoxy or mortar. It could also serve as a great storage container for a user's daily medicines to bring with them for the day.

In one embodiment, any type of container that contains foodstuffs, such as for example, but without limitation, jars for pickles, bottles for ketchup, containers for soup, and the like, and may be containers meant for more than a one-serving size, may also comprise a cap and the proprietary labeling system as described herein. In some configurations, it may be desirable to outfit such a container with a seal and pull-tab to protect the labeling area, even if no accessory cup is also used and no sanitary seal required.

Publications cited throughout this document are hereby incorporated by reference in their entirety. Although the various aspects of the invention have been illustrated above by reference to examples and preferred embodiments, it will be appreciated that the scope of the invention is defined not by the foregoing description but by the following claims properly construed under principles of patent law.

Each and every feature described herein, and each and every combination of two or more of such features, is included within the scope of the present invention provided that the features included in such a combination are not mutually exclusive.

What is claimed is:

1. An apparatus comprising:

an individual beverage container comprising a cap wherein said cap comprises at least one nub, wherein said nub is configured to be a substantially half-spherical shaped protrusion affixed to the cap on said protrusion's flat side and at its opposite spherical side, further comprising a smaller pointed head surface configured to have a scratching point; and an individual beverage container accessory configured to be attachable to said individual beverage container configured to be a size appropriate to slip over the bottom of the individual beverage container without significantly increasing the size, weight or footprint of the individual beverage container and further comprising a linking ring mate at an upper inner surface area of said individual beverage container accessory; and a linking ring configured to securely attach to the outer surface of the individual beverage container such that the inner surface of the linking ring and the outer surface of the individual beverage container create a full seal, and further comprising a linking mechanism at its lower outer surface configured to link and mate with the linking ring mate at the upper inner surface area of said accessory; and a labeling area on said individual beverage container and said individual beverage container accessory comprising a subsurface, at least one color permanently coated onto and affixed to said subsurface, and at least one color of a contrasting nature coated over said at least one color permanently coated onto and affixed to said subsurface and configured to be smudge proof and scratchable with said at least one nub.

2. The apparatus of claim 1, wherein said individual beverage container accessory is configured to be a cup.

3. The apparatus of claim 1, wherein said individual beverage container accessory is configured to be a bowl.

4. The apparatus of claim 1, wherein said individual beverage container accessory is configured to be a cup and a storage container.

5. The apparatus of claim 1, further comprising a tamper evident seal configured to circumnavigate the apparatus at a predetermined area around a midsection and at least cover the labeling area.

6. The apparatus of claim 5 further comprising a pull tab.

7. The apparatus of claim 1 further comprising a cover for the individual beverage container accessory configured to mount said individual beverage container accessory on the bottom or top.

8. The apparatus of claim 1, wherein said individual beverage container is a can.

9. An apparatus comprising:

an individual beverage container comprising a cap wherein said cap comprises at least one nub, wherein said nub is configured to be a substantially half-spherical shaped protrusion affixed to the cap on said protrusion's flat side and at its opposite spherical side, further comprising a smaller pointed head surface configured to have a scratching point; and a labeling area on said individual beverage container comprising a subsurface, at least one color permanently coated onto and affixed to said subsurface, and at least one color of a contrasting nature coated over said at least one color permanently coated onto and affixed to said subsurface and configured to be smudge proof and scratchable with said at least one nub.

10. The apparatus of claim 9, further comprising a tamper evident seal configured to circumnavigate the apparatus at a predetermined area around a midsection and at least cover the labeling area.

11. The apparatus of claim 10 further comprising a pull tab.

12. An apparatus comprising:

a container configured to contain foodstuffs further comprising a cap wherein said cap comprises at least one nub, wherein said nub is configured to be a substantially half-spherical shaped protrusion affixed to the cap on said protrusion's flat side and at its opposite spherical side, further comprising a smaller pointed head surface configured to have a scratching point; and a labeling area on said container comprising a subsurface, at least one color permanently coated onto and affixed to said subsurface, and at least one color of a contrasting nature coated over said at least one color permanently coated onto and affixed to said subsurface and configured to be smudge proof and scratchable with said at least one nub.

13. The apparatus of claim 12, further comprising a tamper evident seal configured to circumnavigate the apparatus at a predetermined area around a midsection and at least cover the labeling area.

14. The apparatus of claim 12 further comprising a pull tab.

* * * * *